United States Patent [19]

Lewis

[11] 4,260,390

[45] Apr. 7, 1981

[54] ADDITIVE-SOLVENT PROCESS TO FORM EMBOSSED PRODUCT

[75] Inventor: Robert D. Lewis, Landisville, Pa.

[73] Assignee: Armstrong Cork Company, Lancaster, Pa.

[21] Appl. No.: 102,246

[22] Filed: Dec. 10, 1979

Related U.S. Application Data

[63] Continuation-in-part of Ser. No. 637,897, Dec. 5, 1975, abandoned.

[51] Int. Cl.[3] ..... D06P 5/00

[52] U.S. Cl. ..... 8/481; 8/929; 156/84; 156/85; 156/277; 428/85; 428/92; 428/96

[58] Field of Search ..... 156/84, 85, 148, 277, 156/305; 428/85, 92, 96; 8/14, 17, 62, 66, 114, 114.5, 115, 130.1, 14 B

[56] References Cited

U.S. PATENT DOCUMENTS

| | | | |
|---|---|---|---|
| 2,110,866 | 3/1938 | Castles | 8/115 |
| 2,723,937 | 11/1955 | Rice | 156/177 |
| 3,053,609 | 9/1962 | Miller | 8/17 |
| 3,228,745 | 1/1966 | Galatioto | 156/85 |
| 3,236,587 | 2/1966 | Gevereaux | 8/130.1 |
| 3,567,548 | 3/1971 | Miller | 8/17 |
| 3,830,683 | 8/1974 | Bohrn | 428/92 |
| 3,849,158 | 11/1974 | Palmer et al. | 8/17 |
| 3,849,159 | 11/1974 | Palmer et al. | 156/277 |
| 3,856,598 | 12/1974 | Gregorian et al. | 156/85 |
| 3,945,791 | 3/1976 | Bohrn | 428/96 |

FOREIGN PATENT DOCUMENTS 544820 4/1942 United Kingdom .

*Primary Examiner*—Caleb Weston

[57] ABSTRACT

A pile fabric is treated overall with a solution containing a solvent for the fiber comprising the pile fabric. The solvent concentration of the solution is of a low enough level to produce little or no shrinkage by itself upon subsequent application of heat. Portions of the fabric before heating are treated with a solution to increase the solvent concentration on the pile fabric to a point where the solvent will have a shrinking effect on the fabric. The subsequently heated product then has an embossed effect.

5 Claims, 2 Drawing Figures

ADDITIVE-SOLVENT PROCESS TO FORM EMBOSSED PRODUCT

CROSS REFERENCE TO RELATED APPLICATION

This application is a continuation-in-part of U.S. Application Ser. No. 637,897 filed Dec. 5, 1975, abandoned, in the name of Robert D. Lewis and entitled "Additive-Solvent Process to Form Embossed Product."

BACKGROUND OF THE INVENTION

1. Field of the Invention

The invention is directed to a fabric treatment process and, more particularly, to a technique for the solvent embossing of carpet.

2. Description of the Prior Art

Pile carpets presenting an embossed appearance were originally made by weaving a pile carpet fabric with tufts of uniform height and thereafter cutting certain of the tufts or pile yarns by hand to desired design or pattern, or, alternately, they were woven with pile yarns of different heights by means of specially equipped looms, such as Wilton looms, with special jacquard or pile wire mechanisms. These methods and the equipment required were slow, costly, and required specialized skills.

Various attempts have been made to create an embossed pattern effect on tufted pile carpet material by less expensive equipment and processes. Thus, as shown in U.S. Pat. No. 2,723,937, it has been proposed to apply adhesive to the pile of a carpet material and then subject the pile of the carpet to compacting by heated rollers in a desired design pattern. It has also been proposed in U.S. Pat. No. 3,567,548 to impart an embossed design appearance to carpet and other pile fabric material by printing the surface of the carpet in the desired pattern with a solvent material which may contain adhesive. Thereafter, the fabric is subjected to dry heat and to compacting and finally to relofting of the pile elements. These prior art attempts to obtain an embossed pattern effect in tufted carpet material by means of a solvent and/or adhesive have proven to be generally unsatisfactory and had many shortcomings. Thus, where adhesive is employed in connection with compacting of the pile yarns to attain a sculptured or embossed effect, various chemicals, such as dry cleaning fluids along with abrasion, serve to release a certain portion of the compacted pile yarns, thus destroying the desired embossed design appearance or destroying or spoiling the uniformly sculptured appearance thereof. When an attempt is made to attain the desired sculptured or embossed design appearance by means of solvents, it is difficult to obtain a uniformly embossed appearance or an aesthetically acceptable appearance, particularly to the desired depth of embossing to present the proper sculptured appearance.

It has also been proposed to treat the entire face surface of a tufted carpet material with a dilute solution of a solvent so as to impart the desired bonded finish to the face fibers as shown in U.S. Pat. No. 3,053,609. However, no pattern embossed effect is obtained by means of this procedure.

Materials other than carpet materials have been also treated with various solvents and adhesive to obtain various effects, but these various processes and treatments do not present the same problems as are encountered in creating an embossed pattern effect on tufted carpet material. Thus, in U.S. Pat. No. 2,110,866, relatively light-weight upholstery or decorative pile fabric having tufted face surface yarns made of animal fibers, such as wool or mohair, are treated with a relatively dilute solution or paste to shrink the animal fibers. However, the process disclosed in the above patent cannot practically be employed to create a satisfactory embossed pattern effect on all tufted carpet material, particularly on all tufted carpet material in which the face yarns are made of synthetic materials.

In U.S. Pat. Nos. 705,977 and 1,980,191, a decorative pile fabric such as an upholstery fabric is treated with a solvent so as to completely destroy the fibers in the treated areas, and the destroyed fibers are then removed by brushing. The processes disclosed in these patents would not be applicable to tufted carpet material to produce the desired sculptured design effect and the complete destruction of the pile yarns in the treated areas would, for most purposes, destroy the desired embossed appearance and the utility of the product.

In addition to the foregoing, plain non-pile fabrics have also been treated in selected areas with various solvents to impart a wrinkled or seersucker appearance to the fabric as shown in U.S. Pat. No. 3,505,000 and British Pat. No. 544,820, accepted Apr. 28, 1942. The treatment disclosed in these patents is quite unsuited for a tufted carpet material since a crinkled or seersucker effect would prevent the carpet from lying smoothly or evenly on the floor and since it would not give the desired sculptured or embossed effect to the tufted pile face.

SUMMARY OF THE INVENTION

The invention involves the treatment of a pile fabric to secure an embossed effect thereon. A heavy pile fabric, for example carpeting, is treated overall with a solution containing a solvent for the fiber comprising the pile fabric. The concentration of the solution is at a low enough level to produce little or no shrinkage of the fiber yarns of the pile fabric upon subsequent application of heat or steam. The solvent wetted fabric is printed with one or more decorative or solvent inks of higher concentration than the first or wet-out concentration of solvent. After treatment, in the unprinted areas of the fabric, little or no fiber shrinkage occurs due to the low level of etching solvent present; while in the areas printed with the etching ink, a greater (deeper) amount of etching occurs than would be normally expected with the second applied etching ink due to the "additive" effect of the solvent of the first wet-out coating and the ink printing. In areas which may be printed with non-solvent inks, no etching or shrinkage at all can occur due to the fact that the non-solvent inks further dilute the wet-out concentration of solvent. It should be noted that multi-levels may be secured based upon how the additive effect of second applied printed ink designs may additively affect the first applied wet-out concentration of solvent. This all results in a very pleasing sculptured visual with the non-overprinted area raised above the areas overprinted with the second solvent inks. Dyes can be added to the printing solution to simultaneously dye the printed areas if desired.

DESCRIPTION OF THE PREFERRED EMBODIMENTS

Figure 1:
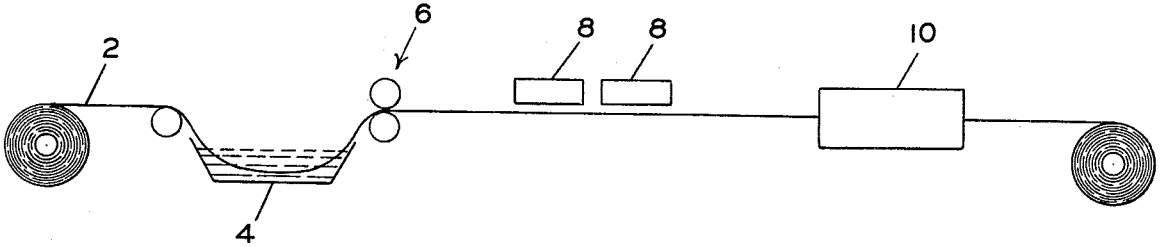
FIG. 1 is a schematic view of the process of making the product herein.

Referring now to the FIG. 1 embodiment in the drawing, a pile fabric, for example carpeting 2, is provided with an overall coating of a solution containing a solvent for the fiber comprising the pile fabric. As shown in FIG. 1, the carpet 2 is dipped in a tank 4 having the solvent solution. The solution may or may not contain dyes. Dyes would serve for background coloration. The solvent solution could also be applied by a conventional padding operation. The carpet is then passed through squeeze rolls 6 which remove the excess solution from the carpet 2. The concentration of the solvent in the solution is at a sufficiently low level so as to induce little or no shrinkage of the fiber yarns of the pile fabric upon a subsequent application of heat or steam. Should the pile fabric move from the squeeze rollers into the heating chamber, the solvent would act upon the carpet uniformly and there would be no definite shrinkage (less than 5% shrinkage of the pile height) in the pile height of the fabric.

However, the overall solvent treated carpet 2, which has now had the wet-out concentration of solvent, is not heated, but is passed to a series of printing stations 8. Here the fabric will be printed with a design using any required number of printing stations. The printer could be a flat bed screen printer, a rotary screen printer or other like equivalent printers. The printing ink may contain dyes or may be colorless. The important thing at this point is that some of the printing inks contain the solvents at such a concentration that in conjunction with the solvent in the wet fabric, upon further treatment, they will act upon the fabric uniformly and there would be, depending on the solvent concentration in the printing ink, about 50% shrinkage in the pile height of the fabric. In the areas printed with non-solvent inks, the printing solution will tend to dilute the "overall" or "wet-out" solvent-containing solution and result in no fiber shrinkage in these areas. This diluted effect may not even be necessary if the overall solvent containing solution is already too weak to cause shrinkage. The carpet then passes into a heating chamber 10 which would be any conventional heating means, preferably though it should be saturated steam. The heating will set the dyes if they are used, and at the same time cause the solvent, if at a high enough concentration, to shrink the pile loops of the pile fabric. Conventional washing and drying can then be carried out.

Figure 2:
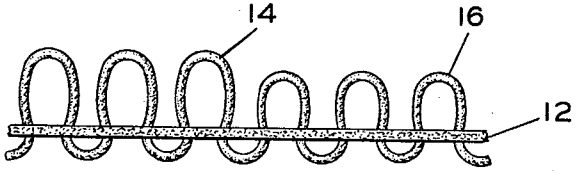
FIG. 2 is a cross-sectional view of a product made according to the process herein.

There is then formed the product which is shown in FIG. 2. The conventional backing 12 has the loops tufted therethrough and the loops 14 occur in those areas where there has been printed only the wet-out concentration of solvent or where there has been printed non-solvent decorative inks, while the loops 16 result in those areas where there has been the wet-out concentration of solvent plus the printing of solvent containing inks. The process can be equally well employed with either loop or cut pile fabrics.

In one practical form of the invention, the tufted pile acrylic carpet material, having a non-woven polypropylene backing with a tufted face surface yarn having a denier of about 5,200 needled thereinto to a weight of 35 ounces per square yard of carpet material, is passed into a dip tank 4 containing an aqueous solution of ethylene carbonate with the ethylene carbonate comprising approximately 20% by weight of the solution. Acceptable visual effects can be secured by using a concentration of ethylene carbonate in the above solution ranging from about 25% to 60% by weight of the aqueous solution. It has been found that if the ethylene carbonate is in a solution at a concentration of less than about 25% by weight of the solution, the ethylene carbonate will have no effect upon the carpet tufts as far as shrinkage of the tufts is concerned. Consequently, it can be seen that a concentration in the range of about 10% to 25% will not cause any shrinkage while a concentration in the range of 25% to 30% in the initial dip tank 4 may result in a minor shrinkage in the carpet.

It is obvious that the carpet will be fairly well saturated with solution when it is passed through the dip tank. However, the squeeze rolls 6 remove excess material from the carpet so that there exist on the carpet about 0.76 ounces of solvent per square foot of carpet. The carpet then passes to the printing station 8 where there is printed a carpet design thereon using an aqueous solution of basic blue 69 dye plus ethylene carbonate in a concentration which may range from about 25% to 55% by weight of the aqueous solution of dye. The printer then places a pattern on the carpet surface and applies the inks in the solution at a rate of about 9.1 ounces of ink solution per square foot (55% solvent by weight). This means that the solvent now existing on the fibers came not from the dip tank 4 alone, but is the composite of the solvent from the dip tank and the solvent from the ink solution from the printer. The result is that the second ink solution raises the concentration of ethylene carbonate to approximately 45% by weight of the total solution. The carpet then passes through a steaming chamber in which saturated steam at a temperature of approximately 212° F. to 220° F. is applied to the carpet for about five minutes. This then provides the carpet product shown in FIG. 2.

In another example of the invention herein, a tufted pile nylon carpet material having a woven polypropylene backing with a tufted face surface yarn having a denier of about 3,825 needled thereinto to a weight of 28 ounces per square yard of carpet material is passed into a dip tank 4 containing an aqueous solution of zinc chloride with the zinc chloride comprising approximately 25% by weight of the solution and applied at the rate of 0.57 ounces of solvent per square foot of carpet. This concentration of solvent is not sufficient to provide a definite embossed effect. At a concentration of about 55% and up to 62.5% of solvent an acceptable embossing will occur. The printing ink containing solvent which is applied after this point must increase the amount of solvent on the fiber to the equivalent of a concentration of about 55% solvent in ink to secure embossing. Overprinting an ink material at an application of about 5.1 ounces per square foot with a solvent concentration at 43% by weight of the solution will increase the solvent concentration on the fiber to 55% solvent per ink weight so that acceptable embossing will occur.

In another example of the invention herein, a pile polyester carpet material having a woven polypropylene backing with a tufted face surface yarn having a denier of about 13,500 needled thereinto to a weight of 45 ounces per square yard of carpet material is passed into a dip tank 4 containing an aqueous solution of phenol with the phenol comprising approximately 60% by weight of the solution and applied at the rate of 10.1 ounces of solvent solution per square yard of carpet. This concentration of solvent is not sufficient to provide a definite embossed effect (0.67 ounces of solvent per square foot). At a concentration of about 70% and up to 90% of solvent an acceptable embossing will occur. The printing ink containing solvent which is applied after this point must increase the amount of solvent on the fibers to about 75% to secure embossing. Overprinting an ink material at an application of about 5.1 ounces per square foot with a solvent concentration at 65% by weight of the solution will increase the solvent concentration on the fiber to a 77% ink equivalent concentration (3.97 ounces of solvent per square foot) so that acceptable embossing will occur.

The above three examples refer to three commonly used pile fabric materials. It is obvious that other materials could be used, such as wool, rayon, etc. The best practical solvents have been indicated for the above fibers. However, it is obvious that other solvents could be used. For example, certain nylon fibers can be treated with resorcinol, while other nylon fibers can be treated with zinc chloride. Likewise, solvent concentrations can be varied so that both the printed and non-printed areas would have some yarn shrinkage. A multi-level effect could be secured by putting the wet-out solution down in a concentration wherein some embossing would occur and then in subsequent printing operations, solvent containing ink could be put down to increase the concentration of solvent in some areas, while non-solvent containing inks could be put down in other areas to dilute the solvent in the wet-out solution to a point that no embossing would occur. Thus, you would get three levels of embossing: a no embossing level where non-solvent inks had diluted the wet-out concentration to the point that no shrinkage has occurred; a little shrinkage in areas where only the wet-out solution was applied and it is sufficiently strong to cause a little shrinkage; and a third level will be secured where the wet-out concentration of solvent is reinforced by additional solvent-containing ink so that deep embossing can occur. It is equally true that the wet-out solution could be of a low enough concentration that it would provide no embossing and then inks could be applied with different concentrations of solvent so that those areas printed with the inks of the higher concentration of solvent would tend to shrink more and be embossed more deeply than areas printed with other inks with lower concentrations of solvents therein. Finally, it is obvious that if the weight of the carpet structure is changed, so too the various concentrations must be varied. A heavier carpet will require more solvent. The essence of the invention resides in the fact that there is an overall coating of a pile fabric with a material that has a solvent therein that will generally not affect the pile fabric to cause it to shrink. Then certain portions of the total surface area which have been totally treated with a solvent are printed with a second solvent solution which results in an increase in the solvent concentration on the fibers to reach the equivalent of that which could be secured when an ink alone is used with sufficient solvent to cause embossing in the printed areas. In effect, what is being done is to break the ink solvent mixture needed for embossing into two parts. Assume 4 ounces of solvent is needed with the ink when used without the solvent prewet to cause embossing. Herein the solvent in the ink is reduced to about 3.5 ounces and the prewet solution is provided with the additional 0.5 ounces needed to move the solvent amount on the fibers to 4 ounces. The prewet causes little or no embossing. The printing ink with solvent will provide some embossing. The total of the solvent in the prewet and ink (4 ounces of solvent) cause the desired embossing (embossing greater than that which could be caused by the ink/solvent mixture). The prewet water dilutes the solvent in the prewet solution to prevent embossing, but in the total application of prewet and ink solutions, the prewet water has no dilutive effect. The key herein is to get the desired total amount of solvent on the fibers (from the prewet solution and the ink) and this amount of solvent must equal the amount of solvent used in the ink alone when it is causing the desired embossing. This results in the finished product having a difference in shrinkage between those areas that are printed versus those areas that are not printed. This difference herein means that those areas which are printed with a solvent will have a greater shrinkage than those areas which are not printed.

What is claimed is:

1. The method of forming an embossed pattern effect on pile fabric material which consists of the steps of:

(a) first providing a carpet material with a backing and a pile fiber upper face surface, the pile surface containing fibers which may be shrunk by a selected solvent while the backing material will be unaffected by the solvent;

(b) applying a first fiber shrinking solvent to at least part of the fiber face of the carpet, said solvent being in solution and being of a low enough concentration therein to cause no definite embossing of the pile face surface yarns;

(c) subsequently applying in a desired pattern to at least part of the areas containing said first applied solvent-containing solution, a second fiber shrinking solvent-containing solution, which solvent is the same as the first solvent applied, which solvent is at a concentration such that it can cause some fiber shrinkage, and which second solvent will increase the concentration of total solvent in at least some of those areas where the originally applied solvent-containing solution was applied to the point that the total solvent in those areas will be at a concentration sufficient to substantially shrink the fibers of the pile surface; and thereafter, (d) subjecting the pile fabric to heat to cause the yarns in the fiber face surface which have been only wetted by the first fabric solvent-containing solution not to shrink, while in those areas where there has been a printing of the second solvent solution, the total solvent concentration has been increased to the point that the solvent causes shrinkage of fibers in the pile face surface to provide the desired embossed appearance.

2. The method of claim 1 wherein (a) a third solvent-containing solution is applied to areas not printed with the second solvent-containing solution, but printed with the originally applied first solvent-containing solution, said third solvent-containing solution being the same solvent as the first solvent applied and having a solvent concentration different from the solvent concentrations of the first and second solvent-containing solutions.

3. The method of creating an embossed pattern effect on a fibrous material as set forth in claim 1 wherein (a) the printed second solution contains dyes to color the pile fabric in the printed areas.

4. The method of creating an embossed pattern effect on a fibrous material as set forth in claim 1 wherein (a) the first solvent-containing solution contains a dye.

5. The method of creating an embossed pattern effect on a fibrous material as set forth in claim 1 wherein (a) the first solvent-containing solution contains a concentration of solvent that will produce about 5% shrinkage of the pile face surface yarns, and, (b) certain areas of said fiber face which has been printed only with said first solvent-containing solution is subsequently printed by a third non-solvent containing ink which will dilute the originally applied solvent-containing solution to the point that the solvent in the total solution will have no effect upon the fibers of the pile surface.

* * * * *